US010934978B2

(12) United States Patent
Jung et al.

(10) Patent No.: US 10,934,978 B2
(45) Date of Patent: Mar. 2, 2021

(54) COOLER FOR EXHAUST GAS RECIRCULATION

(71) Applicants: Hyundai Motor Company, Seoul (KR); Kia Motors Corporation, Seoul (KR)

(72) Inventors: Se Wook Jung, Gyeonggi-do (KR); Hee Sool Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/589,963

(22) Filed: Oct. 1, 2019

(65) Prior Publication Data

US 2020/0340430 A1 Oct. 29, 2020

(30) Foreign Application Priority Data

Apr. 24, 2019 (KR) ..... 10-2019-0048099

(51) Int. Cl.
*F02M 26/32* (2016.01)

(52) U.S. Cl.
CPC ..... *F02M 26/32* (2016.02)

(58) Field of Classification Search
CPC .... F02M 26/29; F28D 7/16; F28F 9/01; F28F 9/013; B21D 41/02; B21D 41/028
See application file for complete search history.

(56) References Cited

U.S. PATENT DOCUMENTS

2006/0144585 A1* 7/2006 Ha ..... F01N 3/2889 126/307 R
2011/0308778 A1* 12/2011 Tsuda ..... F02M 26/32 165/157
2013/0192803 A1* 8/2013 Garret ..... F28F 9/0226 165/151
2014/0318109 A1* 10/2014 Yokoo ..... F28D 9/0031 60/320
2014/0352938 A1* 12/2014 Melhem ..... F28D 7/1684 165/173
2015/0136369 A1* 5/2015 Melhem ..... F02M 26/22 165/158
2017/0067417 A1* 3/2017 Kim ..... F28D 9/00
2017/0152816 A1* 6/2017 Ohrem ..... F02M 26/32
(Continued)

FOREIGN PATENT DOCUMENTS

KR 20130056400 A 5/2013

*Primary Examiner* — John Kwon
*Assistant Examiner* — Johnny H Hoang
(74) *Attorney, Agent, or Firm* — Mintz Levin Cohn Ferris Glovsky and Popeo, P.C.; Peter F. Corless

(57) ABSTRACT

A cooler for exhaust gas recirculation is arranged to absorb thermal deformation of a tube by having a modified header structure without additional parts. The cooler for exhaust gas recirculation is applied to an exhaust gas recirculation device. The cooler includes: a body disposed between a pair of flanges connected to an exhaust gas recirculation line; a tube accommodated in the body and having both ends respectively coupled to the flanges through headers such that exhaust gas flows therethrough; and cooling fins accommodated in the body to exchange heat with exhaust gas flowing through the tube, in which the headers are deformed in correspondence to deformation of the tube by expansion and contraction thereof.

5 Claims, 6 Drawing Sheets

(56) References Cited

U.S. PATENT DOCUMENTS

| | | | | |
|---|---|---|---|---|
| 2017/0204812 | A1* | 7/2017 | Grande Fernandez | F02M 26/29 |
| 2019/0331067 | A1* | 10/2019 | Yamada | F02M 26/29 |

* cited by examiner

COOLER FOR EXHAUST GAS RECIRCULATION

CROSS REFERENCE TO RELATED APPLICATION

The present application claims under 35 U.S.C. § 119(a) the benefit of Korean Patent Application No. 10-2019-0048099, filed Apr. 24, 2019, the entire contents of which are incorporated by reference herein.

BACKGROUND

1. Technical Field

The present disclosure relates to a cooler for exhaust gas recirculation, more particularly, to the cooler for exhaust gas recirculation capable of absorbing thermal deformation of a tube by having a modified header structure without additional parts.

2. Description of the Related Art

In general, noxious gases such as carbon monoxide (Co), hydrocarbons (HC), nitrogen oxides (NOx), and particulate matter (PM) are included in automotive exhaust gas.

Accordingly, various devices for suppressing production of noxious gases in automotive exhaust gas have been applied. One of these devices is an exhaust gas recirculation (EGR) device that is used to suppress production of nitrogen oxides.

Such an EGR device is necessarily equipped with a cooler for exhaust gas recirculation, thereby cooling exhaust gas using heat exchange between the exhaust gas and cooling water.

FIG. 1 (RELATED ART) is a cutaway perspective view showing a common cooler for exhaust gas recirculation, and FIG. 2 (RELATED ART) is a cross-sectional view showing main parts of the common cooler for exhaust gas recirculation.

As shown in FIGS. 1 and 2, a common cooler for exhaust gas recirculation includes: a body 30 disposed between a pair of flanges 10 and 20 connected to an exhaust gas recirculation line; a tube 50 accommodated in the body 30 and having both ends respectively coupled to the flanges 10 and 20 through headers 40 such that exhaust gas flows therethrough; and cooling fins 60 accommodated in the body 30 for heat exchange with exhaust gas flowing through the tube 50.

The flanges 10 and 20 are divided into an inlet flange 10 disposed at a side where exhaust gas flows inside and an outlet flange 20 where exhaust gas is discharged.

The inside of the tube 50 may be formed as one flow space, but a plurality of tubes 50 may be disposed adjacent to and in parallel with each other in a longitudinal direction of the body 30. Further, in spaces between the tubes 50, cooling water may directly flow or cooling fins 60 through which cooling water flows may be disposed.

When a plurality of tubes 50 is disposed, the header 40 disposed at the inlet flange 10 allows exhaust gas flowing inside through the inlet flange 10 to flow into the tubes 50 while preventing the exhaust gas from flowing into the spaces where the cooling water flows. Obviously, the header 40 disposed at the outlet flange 20 allows exhaust gas that has exchanged heat through the tubes 50 to flow back into the exhaust gas recirculation line through the outlet flange 20.

On the other hand, the tube 50 is fixed to the flanges 10 and 20 and the body 30 through the header 40 by welding. As the tube 50 is fixed and high-temperature exhaust gas repeatedly exchanges heat to be cooled while flowing through the tube 50, the tube 50 repeatedly expands and contracts due to heat, so thermal stress is accumulated in the tube 50. Accordingly, there is a problem that the tube 50 is damaged or fixed portions between the tube 50 and the header 40 are damaged.

The description provided above as a related art of the present disclosure is just for helping understanding the background of the present disclosure and should not be construed as being included in the related art known by those skilled in the art.

SUMMARY

The present disclosure relates to a cooler for exhaust gas recirculation, more particularly, the cooler for exhaust gas recirculation capable of absorbing thermal deformation of a tube by having a modified header structure without additional parts.

A cooler for exhaust gas recirculation according to an embodiment of the present disclosure is a cooler that is applied to an exhaust gas recirculation device. The cooler includes: a body disposed between a pair of flanges connected to an exhaust gas recirculation line; a tube accommodated in the body and having both ends respectively coupled to the flanges through headers such that exhaust gas flows therethrough; and cooling fins accommodated in the body to exchange heat with exhaust gas flowing through the tube, in which the headers are deformed in correspondence to deformation of the tube by expansion and contraction thereof.

The header is divided into: a base being in contact with an end of the tube and preventing exhaust gas from flowing into a cooling water flow space where cooling water flows in the body; first close contact portions extending from the base and being in close contact with an outer side of an end region of the tube; buffer portions extending and bending from the first close contact portions and deforming in correspondence to deformation of the tube by expansion and contraction thereof; and second close contact portions extending and bending from the buffer portions and being in close contact with an outer side of a end region of the flange.

The buffer portion is not in direct contact with the tube and the flange and is deformed in correspondence to longitudinal and radial expansion and contraction of the tube.

In the header, the first close contact portion extends inward from an end of the tube, the buffer portion extends from the first direct contact portion toward the end from the inside of the tube, and the second close contact portion protrudes from the buffer portion toward the inside from the end of the tube.

The tube is divided into non-installation regions that are defined at both end regions and in which the cooling fins are not installed and an installation region that is defined between the non-installation regions and in which the cooling fins are formed.

The inner diameter of the tube is larger at the non-installation regions than the installation region.

According an embodiment of the present disclosure, since a structure that deforms in correspondence to thermal deformation of a tube is added to the structure of a header fixing the tube to a flange and a body, it is possible to improve durability of a cooler for exhaust gas recirculation by absorbing thermal deformation of the tube.

Further, it is possible to suppress breaking and/or damage to a cooler for exhaust gas recirculation only by improving the structure of a header even without adding specific parts in comparison to common coolers for exhaust gas recirculation.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Figure 1:
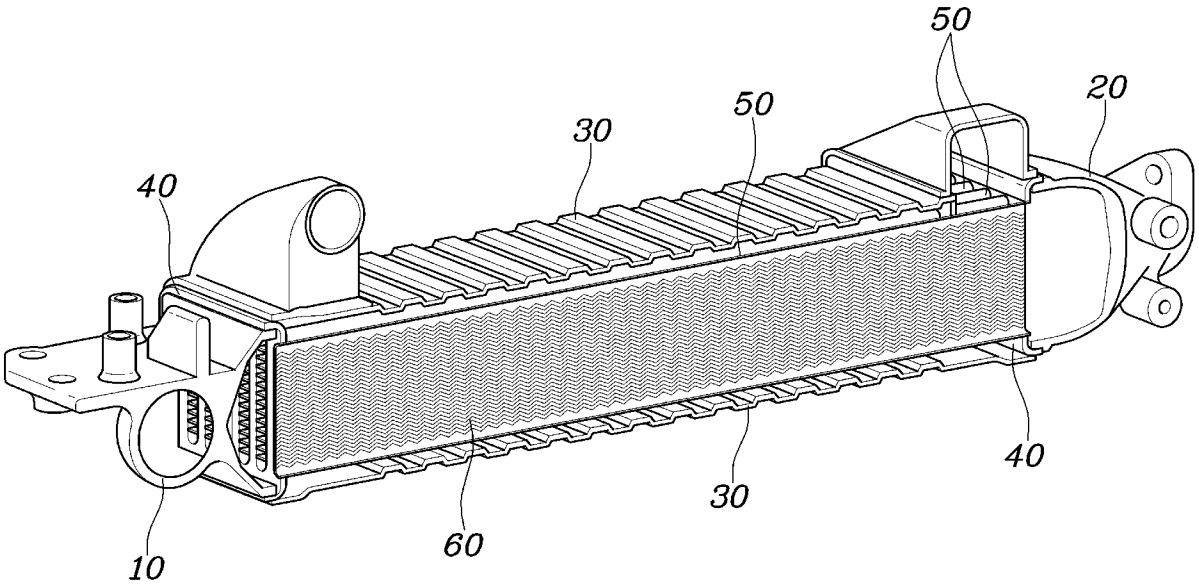
FIG. 1 (RELATED ART)
FIG. 1 (RELATED ART) is a cutaway perspective view showing a common cooler for exhaust gas recirculation.
Figure 2:
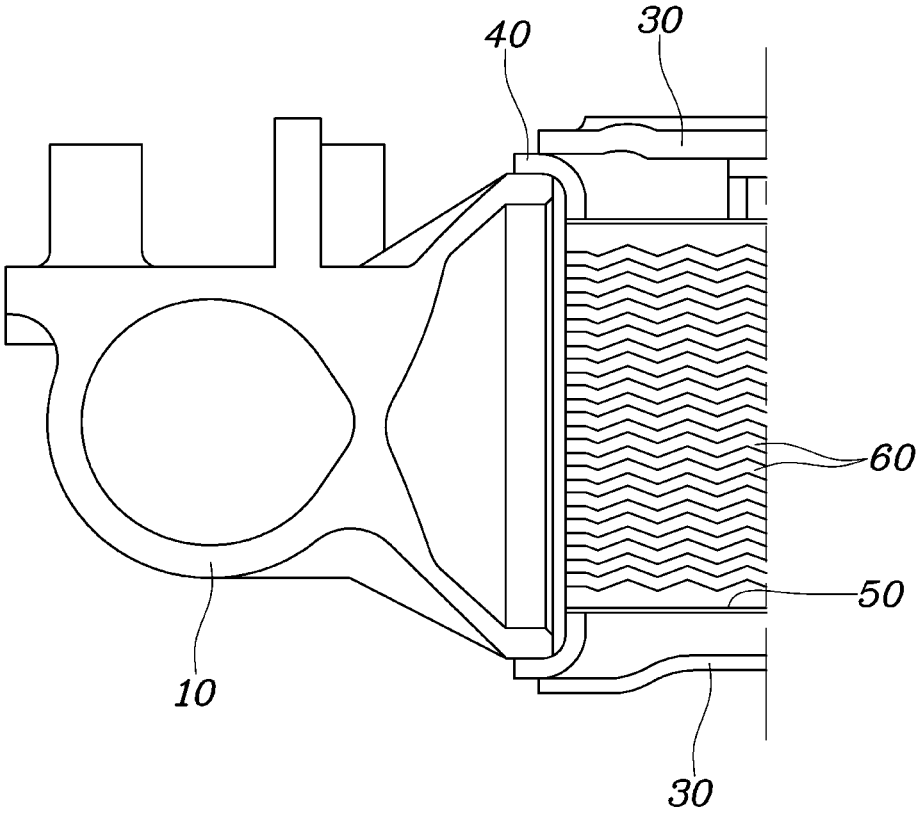
FIG. 2 (RELATED ART)
FIG. 2 (RELATED ART) is a cross-sectional view showing main parts of the common cooler for exhaust gas recirculation.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, embodiments of the present disclosure are described in detail with reference to the accompanying drawings. However, the present disclosure is not limited to the following embodiments and can be implemented in various ways different from one another, and the embodiments are provided to complete the present disclosure and to completely inform those skilled in art of the scope of the present disclosure. The same components are given the same reference number in the drawings.

Figure 3:
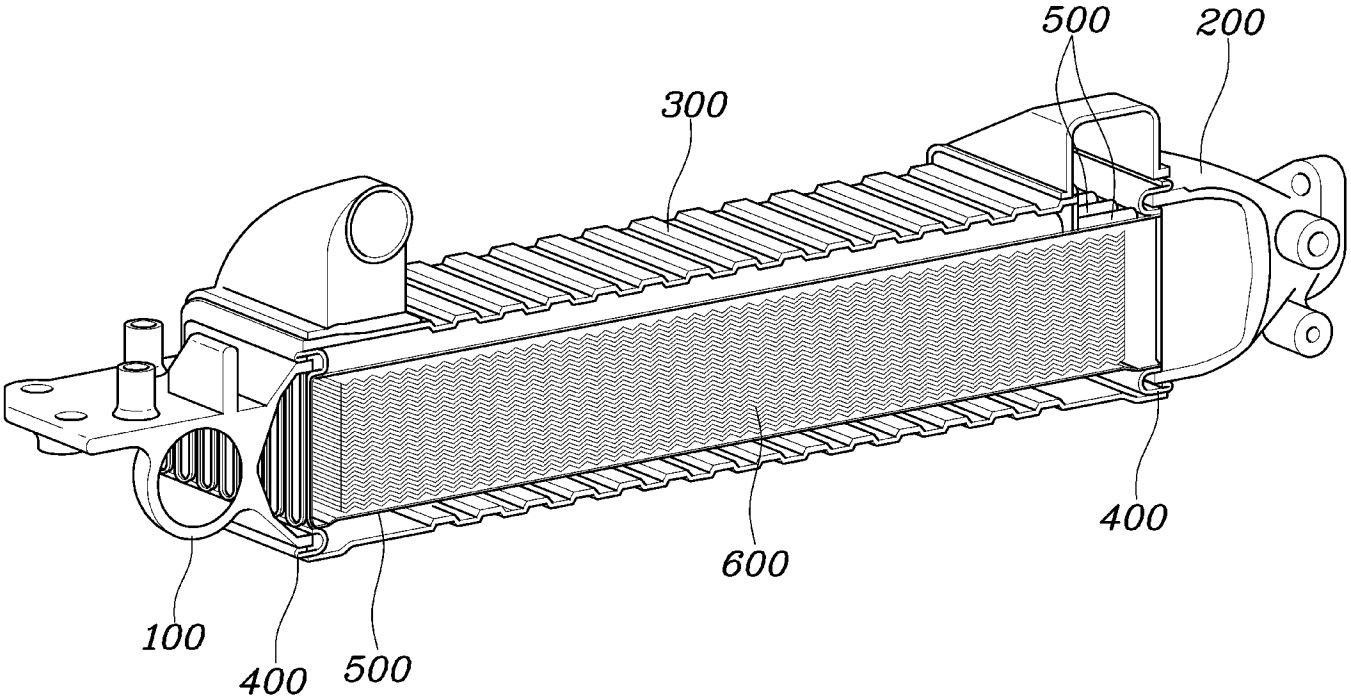
FIG. 3 is a cutaway perspective view showing a cooler for exhaust gas recirculation according to an embodiment of the present disclosure.
Figure 4:
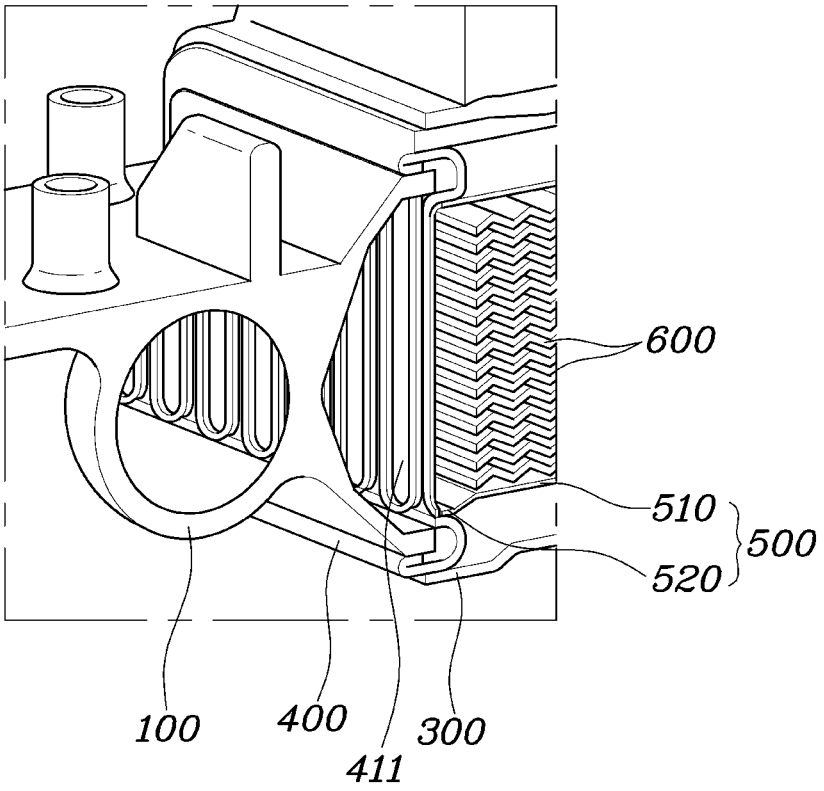
FIG. 4 is a perspective view showing main parts of the cooler for exhaust gas recirculation according to an embodiment of the present disclosure.
Figure 5:
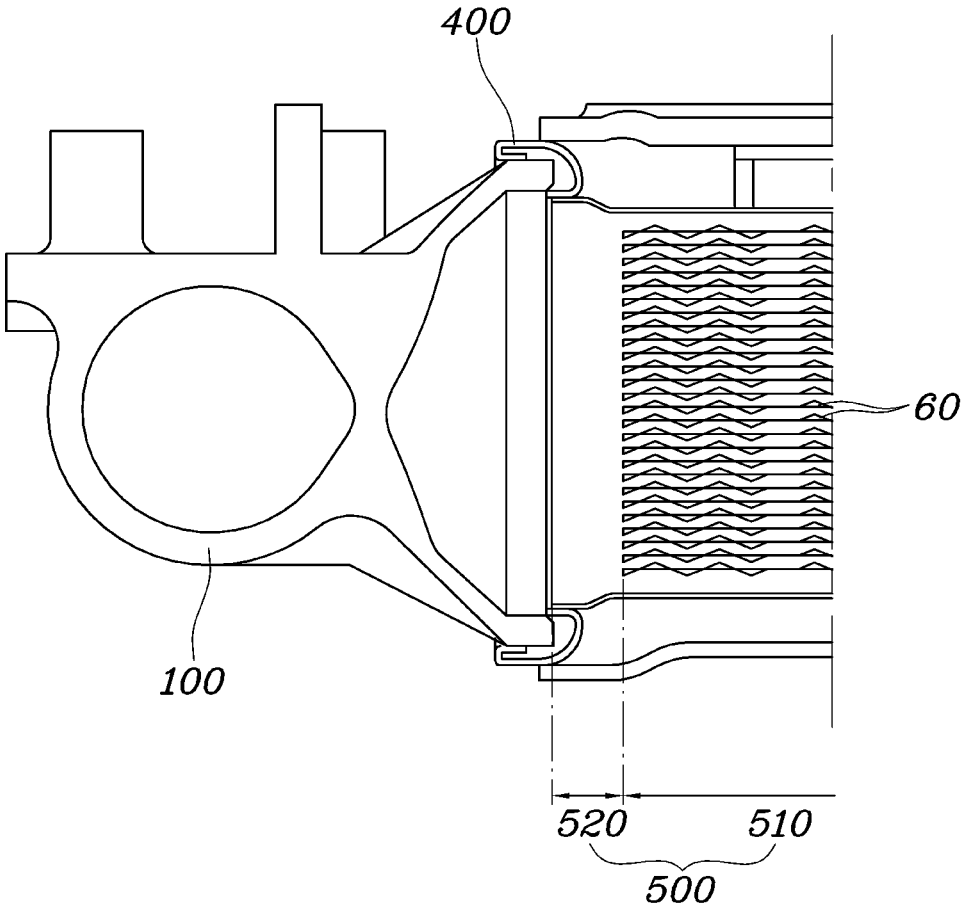
FIG. 5 is a cross-sectional view showing main parts of the cooler for exhaust gas recirculation according to an embodiment of the present disclosure.
Figure 6:
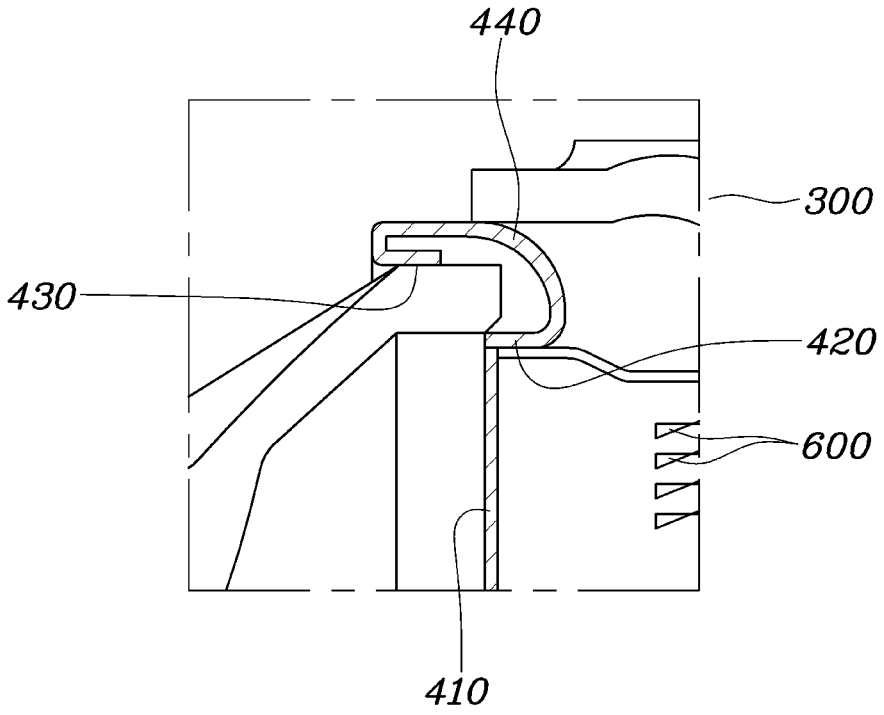
FIG. 6 is an enlarged cross-sectional view showing main parts of the cooler for exhaust gas recirculation according to an embodiment of the present disclosure.

FIG. 3 is a cutaway perspective view showing a cooler for exhaust gas recirculation according to an embodiment of the present disclosure, FIG. 4 is a perspective view showing main parts of the cooler for exhaust gas recirculation according to an embodiment of the present disclosure, FIG. 5 is a cross-sectional view showing main parts of the cooler for exhaust gas recirculation according to an embodiment of the present disclosure, and FIG. 6 is an enlarged cross-sectional view showing main parts of the cooler for exhaust gas recirculation according to an embodiment of the present disclosure.

As shown in FIGS. 3-6, a cooler for exhaust gas recirculation according to an embodiment of the present disclosure is a device that is connected to an exhaust gas recirculation line and cools exhaust gas. The cooler for exhaust gas recirculation includes: a body 300 disposed between a pair of flanges 100 and 200 connected to an exhaust gas recirculation line; a tube 500 accommodated in the body 300 and having both ends respectively coupled to the flanges 100 and 200 through headers 400 such that exhaust gas flows therethrough; and cooling fins 600 accommodated in the body 300 to exchange heat with exhaust gas flowing through the tube 500. In particular, according to the present disclosure, the headers 400 are configured to deform in correspondence to deformation of the tube 500 by expansion and contraction thereof, thereby suppressing breaks and/or damage to the tube 500 and fixed portions between the tube 500 and surrounding parts.

The body 300 is a tube-shaped body having a rectangular or circular cross-section and having an accommodation space therein. First and second ends of the body 300 are connected to an exhaust gas recirculation line by the flanges 100 and 200, respectively. The flanges 100 and 200 are divided into an inlet flange 100 disposed at a side where exhaust gas flows inside and an outlet flange 200 where exhaust gas is discharged.

The tube 500 provides a space where exhaust gas flows, but divides the space where exhaust gas flows into several spaces. In this embodiment, a plurality of tubes 500 is disposed adjacent to and in parallel with each other in the longitudinal direction of the body 300 to divide the space where exhaust gas flows into several spaces.

The cooling fins 600 are disposed between the tubes 500 in the body 300. In the spaces between the tubes 500, cooling water may directly flow or cooling fins 600 through which cooling water flows may be disposed.

In particular, the cooling fins 600 are partially exposed inside the tubes 500 through the tubes 500, so exhaust gas comes in direct contact with the cooling fins, thereby being able to improve heat exchange efficiency. Obviously, the cooling fins 600 may be disposed in contact with only the outer sides of the tubes without being exposed inside the tubes 500 such that heat exchange is made through indirect contact between exhaust gas and the cooling fins 600. The structure related to the arrangement and relationship of the tubes 500 and the cooling fins 600 may be changed in various ways to improve the heat exchange efficiency therebetween.

On the other hand, the headers 400 are disposed at both ends of the tubes 500 to allow exhaust gas to flow into the tubes 500 and prevent the exhaust gas from flowing into the spaces through which cooling water flows. In other words, the header 400 disposed at the inlet flange 100 allows exhaust gas flowing inside through the inlet flange 100 to flow into the tubes 500 while preventing the exhaust gas from flowing into the spaces where the cooling water flows. The header 400 disposed at the outlet flange 200 allows exhaust gas that has exchanged heat through the tubes 500 to flow back into the exhaust gas recirculation line through the outlet flange 200.

To this end, the headers 400 are each divided into: a base 410 being in contact with ends of the tubes 500 and preventing exhaust gas from flowing into a cooling water flow space where cooling water flows in the body 300; first close contact portions 420 extending from the base 410 and being in close contact with the outer sides of the end regions of the tubes 500; buffer portions 440 extending and bending from the first close contact portions 420 and deforming in correspondence to deformation of the tubes 500 by expansion and contraction thereof; and second close contact portions 430 extending and bending from the buffer portions 440 and being in close contact with the outer sides of the end regions of the flanges 100 and 200.

The base 410 is formed in a shape corresponding to a cross-section in a direction perpendicular to the longitudinal direction of the body 300 and is in contact with ends of the tubes 500. A plurality of channel holes 411 is formed at the base 410 to be able to communicate with the tubes 500.

The first close contact portions 420 extends from the portion around the region, where the channel holes 411 are formed, of the base 410 and bends to be in close contact with the end regions of the tubes 500. The first close contact portions 420 may extend and bend toward the insides of the tubes 500 around the channel holes 411 of the base 410.

The buffer portions 440 extend and bend from the first contact portions 420 and then extend and bend back towards the ends from the inside of the tubes 500. The buffer portions 440 may have a sufficient length and width to be able absorb thermal deformation of the tubes 500 in correspondence to the thermal deformation in regions that are not in contact with the flanges 100 and 200 and the body 300.

The second close contact portions 430 extend and bend from the buffer portions 440 and then extend and bend inward from the ends of the tubes 500.

The headers 400, as described above, are each divided into the base 410, the first close contact portions 420, the buffer portions 440, and the second close contact portions 430 that are integrally formed, and the tubes 500 are fixed to the flanges 100 and 200 by the first close contact portions 420 and the second close contact portions 430. However, the buffer portions 440, unlike the first close contact portions 420 and the second close contact portions 430, are not in contact with the tubes 500 and the flanges 100 and 200 to absorb a corresponding thermal deformation amount when the tubes 500 expand and contract due to thermal deformation. Accordingly, even if the tubes 500 fixed to the flanges 100 and 200 longitudinally expand and contract, the buffer portions 440 absorb the deformation amounts, thereby being able to avoid any possible damage to the tubes 500.

On the other hand, the tubes 500 themselves according to an embodiment of the present disclosure may have a structure that suppresses thermal deformation due to expansion and contraction.

For example, since the cooling fins 600 are disposed through the tubes 500 to be exposed inside, exhaust gas comes in direct contact with the cooling fins 600, thereby being able to improve heat exchange efficiency. However, the regions where the cooling fins 600 are disposed are correspondingly thermally deformed.

Accordingly, in this embodiment, the tubes 500 each may be divided into non-installation regions 520 at both ends where the cooling fins 600 are not installed and an installation region 510 where the cooling fins 600 are installed between the non-installation regions 520. Accordingly, the cooling fins 600 are installed only in the installation region 510, whereby relatively large expansion and contraction are induced at the installation region and thermal deformation of the installation region 510 is absorbed by the non-installation regions 520.

To this end, the inner diameter of the tubes 500 is larger at the non-installation regions 520 than the installation region 510 so that thermal deformation of the installation region 510, particularly, thermal deformation of the non-installation regions when expansion and contraction radially occur can be absorbed.

In particular, the first close contact portions 420 of the headers 400 are brought in close contact with the non-installation regions 520 of the tubes 500, whereby it is possible to deformation due to expansion and contraction of the tubes 500 through the non-installation regions 520 of the tubes 500 themselves and through the buffer regions 440 of the headers 400. Accordingly, the efficiency of absorbing thermal deformation of the tubes 500 can be improved.

Although the present disclosure was described above with reference to the accompanying drawings and preferable embodiments, the present disclosure is not limited thereto, but is limited to the following claims. Accordingly, those skilled in the art may change and modify the present disclosure in various ways without departing from the spirit of the claims.

What is claimed is:

1. A cooler for exhaust gas recirculation that is applied to an exhaust gas recirculation device, the cooler comprising:

a body disposed between a pair of flanges connected to an exhaust gas recirculation line;

a tube accommodated in the body and having both ends respectively coupled to the flanges through headers such that exhaust gas flows therethrough; and cooling fins accommodated in the body to exchange heat with exhaust gas flowing through the tube, wherein the headers are deformed in correspondence to deformation of the tube by expansion and contraction thereof, wherein each of the headers is divided into:

a base being in contact with an end of the tube and preventing exhaust gas from flowing into a cooling water flow space where cooling water flows in the body;

first close contact portions extending from the base and being close in contact with an outer side of an end region of the tube;

buffer portions extending and bending from the first close contact portions and deforming in correspondence to deformation of the tube by expansion and contraction thereof; and second close contact portions extending and bending from the buffer portions and being in close contact with an outer side of an end region of the flange.

2. The cooler of claim 1, wherein the buffer portion is not in direct contact with the tube and the flange and is deformed in correspondence to longitudinal and radial expansion and contraction of the tube.

3. The cooler of claim 1, wherein in each of the headers, the first close contact portion extends inward from an end of the tube, the buffer portion extends from the first direct contact portion toward the end from the inside of the tube, and the second close contact portion protrudes from the buffer portion toward the inside from the end of the tube.

4. The cooler of claim 1, wherein the tube is divided into non-installation regions that are defined at both end regions and in which the cooling fins are not installed and an installation region that is defined between the non-installation regions and in which the cooling fins are formed.

5. The cooler of claim 4, wherein an inner diameter of the tube is larger at the non-installation regions than the installation region.

* * * * *